US009468826B2

(12) United States Patent
Smith

(10) Patent No.: US 9,468,826 B2
(45) Date of Patent: Oct. 18, 2016

(54) BASKETBALL NET DEVICE AND IMPROVEMENTS THEREIN

(71) Applicant: Jason Paul Smith, Toronto (CA)

(72) Inventor: Jason Paul Smith, Toronto (CA)

( * ) Notice: Subject to any disclaimer, the term of this patent is extended or adjusted under 35 U.S.C. 154(b) by 0 days.

(21) Appl. No.: 14/317,700

(22) Filed: Jun. 27, 2014

(65) Prior Publication Data

US 2015/0375075 A1 Dec. 31, 2015

(51) Int. Cl.
*A63B 63/08* (2006.01)

(52) U.S. Cl.
CPC ..... *A63B 63/083* (2013.01); *A63B 2209/00* (2013.01)

(58) Field of Classification Search
CPC ..... A63B 63/083
USPC ..... 473/448, 485, 483, 489; 70/458; D21/703
See application file for complete search history.

(56) References Cited

U.S. PATENT DOCUMENTS 1,974,499 A * 9/1934 Luce ..... A44B 15/00 24/16 PB
3,814,359 A 6/1974 Powell
3,852,982 A * 12/1974 Faris ..... A44B 15/00 70/457
4,805,903 A * 2/1989 McArdle ..... A63B 63/083 473/489
4,834,368 A 5/1989 Qualley
4,903,964 A 2/1990 Anderson
4,905,995 A 3/1990 Apo
5,098,091 A 3/1992 McGiven
5,123,642 A 6/1992 Stokes
5,156,394 A 10/1992 Deal
5,360,208 A * 11/1994 Fang ..... A63B 63/083 473/489
5,405,132 A * 4/1995 St. Onge ..... A63B 63/083 473/489
5,458,325 A * 10/1995 Klein ..... A63B 63/083 473/485
5,584,479 A * 12/1996 Smith ..... A63B 63/083 473/474
2015/0375075 A1* 12/2015 Smith ..... A63B 63/083 473/489

OTHER PUBLICATIONS

Webpage download, Injectionmoldingva, 2014, www.injectionmoldingva.com/Plastic-Part-Design.php, 6 pages.*

* cited by examiner

*Primary Examiner* — Gene Kim
*Assistant Examiner* — M Chambers
(74) *Attorney, Agent, or Firm* — Bennett Jones LLP

(57) ABSTRACT

A basketball net device for mounting on a raised basketball hoop or ring from a position well below the basketball hoop. The basketball net device comprises an annular member or hoop ring having a hoop ring section for coupling to the basketball ring. The annular member includes an annular skirt section configured to extend and be positioned inside the basketball ring and support a net. According to an embodiment, the net is connected to the annular skirt section utilizing fasteners configured to secure the net and allow the net to pivot or rotate relative to the annular skirt section to emulate the game play of a conventional net mounted on the basketball hoop. According to another embodiment, the net comprises cords made from a tightly weaved material resulting in a net that is stiffer than a conventional net. According to a further aspect, the basketball net device is disengaged from the basketball hoop by shooting a ball into the lower section of the net and catching the basketball device as it falls to the ground.

18 Claims, 10 Drawing Sheets

BASKETBALL NET DEVICE AND IMPROVEMENTS THEREIN

FIELD OF THE INVENTION

The present invention relates to a basketball hoop more particularly, to a device and method for mounting a net in a basketball hoop.

BACKGROUND OF THE INVENTION

In the well-known sport of basketball, a basketball hoop for receiving a ball is mounted at each end of a basketball court, and the hoop is configured for supporting a generally tubular netting through which the basketball can pass. Each hoop is rigidly mounted utilizing one or more support arms and located in front of a backboard. The basketball hoop, typically a metal ring, has an inside diameter of eighteen inches and is normally positioned ten feet above the ground or court playing surface.

Because of the height of the basketball hoops, it can be difficult under some circumstances to install a new or replacement net on the hoop. Typically, a ladder or suitable platform is required to reach the hoop and install the new net.

There are many outdoor basketball courts and outdoor areas where basketball can be played. Although many of these courts have suitable basketball hoops installed at the end of the courts, often these hoops do not have any nets attached. The lack of a net may be due to several possible reasons including the height of the hoops from the court or playing surface, which heights make it difficult for maintenance personnel to replace the nets. Also, the heavy use of public courts may make the life expectancy of the nets quite short, and it may be too expensive for the owner to replace the nets frequently. The nets may also be stolen in such areas or simply destroyed because of improper use. Despite these problems with nets or the lack thereof, most basketball players prefer to play basketball with basketball hoops at each end with nets installed in place. When a net is mounted on each hoop, there can be little dispute as to whether the ball has or has not passed through the hoop when a shot is made. When a net is missing from the basketball hoop, the ball can pass so quickly through the hoop that disputes may arise as to whether or not the shot was actually made.

U.S. Pat. No. 5,584,479 described a novel basketball net device for mounting on a basketball hoop, and further configured for easily removing the basketball net device from an elevated basketball hoop without the use of a ladder or a pole.

The present invention is directed to a novel basketball net device and improvements therein.

BRIEF SUMMARY OF THE INVENTION

The present invention is directed to a basketball net device and a method for mounting the basketball net device on an elevated basketball hoop and a method for removing or dismounting the basketball net device from the elevated hoop.

In a first aspect, the present invention comprises a basketball net device for mounting on a basketball ring, said basketball net device comprises: a tubular net having upper net cords and configured to receive a basketball and permit passage of the basketball through said tubular net; a flexible annular member comprising a generally circular circumference and having a hoop engaging section comprising a channel extending around a substantial portion of the flexible annular member and configured for receiving the basketball ring, and the flexible annular member further comprising an annular skirt section configured to be positioned inside of the basketball ring; the annular skirt section including a plurality of net attachment sections, each of the net attachment sections including an aperture configured to receive a hook ring clasp for coupling a section of one of said upper net cords to the annular skirt section, and the aperture being further configured to allow the hook ring clasp to pivot and rotate together with the upper net cord relative to said flexible annular member; wherein a circumferential section of the annular member has an outer portion of the hoop engaging section cut away forming a narrow inner portion configured to engage an inner half of an upper surface on the basketball ring; and wherein, outside of the circumferential section, the flexible annular member includes an outwardly extending flange connected to the hoop engaging section, and the outwardly extending flange extending along the annular member for than one half of the circular circumference of the flexible annular member.

In another aspect, the present invention comprises a basketball net device for mounting on a hoop ring, the basketball net device comprises: a tubular net configured to receive a ball and permit passage of the ball through the tubular net; a flexible annular member comprising a generally circular circumference and having a hoop engaging section comprising a channel extending around a substantial portion of the flexible annular member and configured for receiving the hoop ring, and the flexible annular member further comprising an annular skirt section configured to be positioned inside of the hoop ring; the annular skirt section comprising a substantially uniform wall thickness and a plurality of net attachment sections, each of the net attachment sections having a thickness greater than the uniform wall thickness so as to provide a reinforced section for supporting the tubular net, and each of the plurality of net attachment sections including an aperture for receiving a fastener for coupling a section the tubular net to the annular skirt section; wherein a circumferential section of the annular member has an outer portion of the hoop engaging section cut away forming a narrow inner portion configured to engage an inner half of an upper surface on the hoop ring; and wherein, outside of the circumferential section, the flexible annular member includes an outwardly extending flange connected to the hoop engaging section, and the outwardly extending flange extending along the annular member for than one half of the circular circumference of the flexible annular member.

Other aspects and features of the present invention will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example, embodiments of the present invention, and in which.

Like reference numerals indicate like or corresponding elements or components in the drawings.

DETAILED DESCRIPTION OF THE EMBODIMENTS OF THE INVENTION

Reference is first made to FIGS. 1 to 4, which show a basketball net device according to an embodiment of the present invention, and indicated generally by reference 100.

Figure 3:
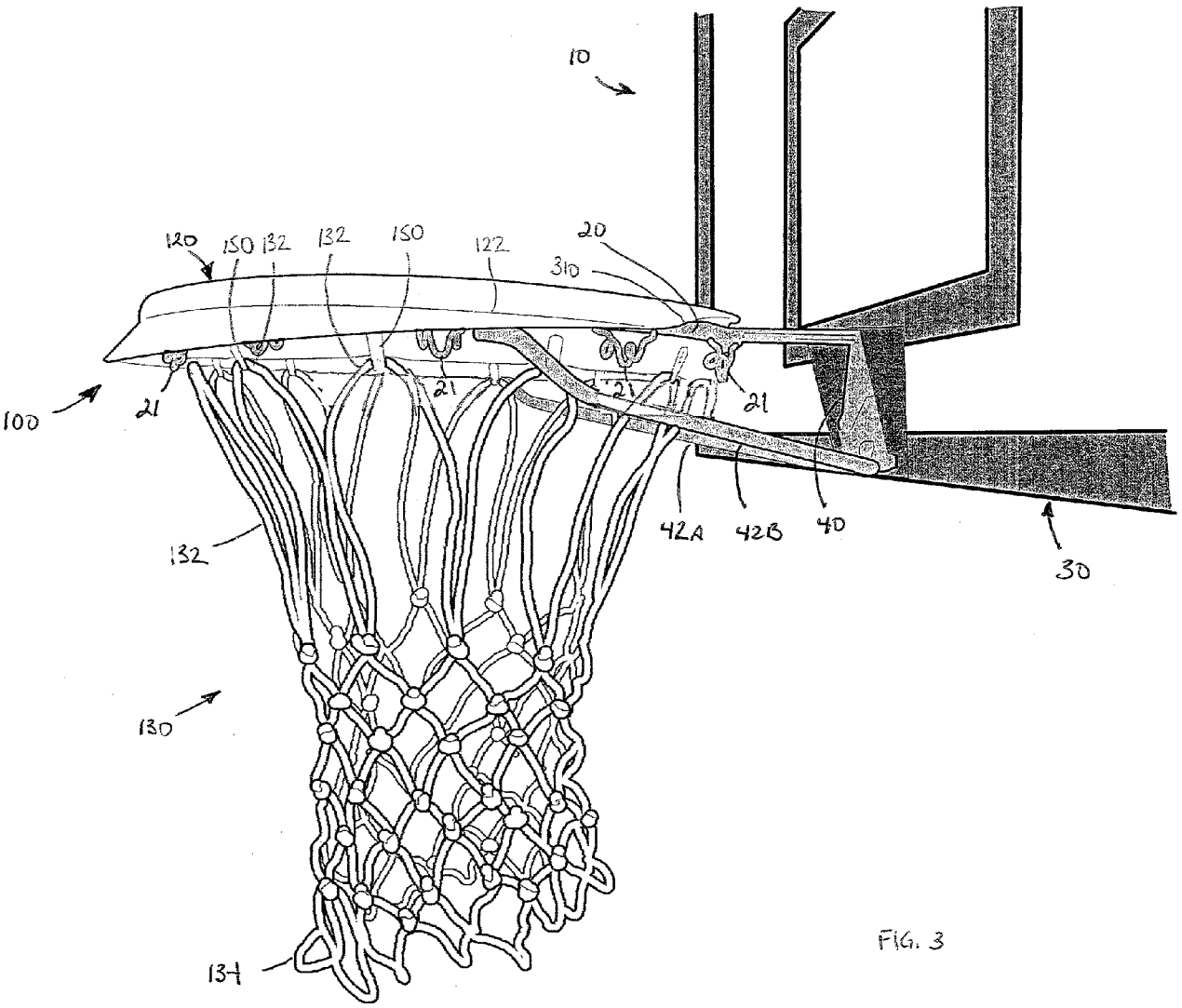
FIG. 3 is a perspective side view of the basketball net device of FIG. 1.

The basketball net device 100 is mounted temporarily on a permanently installed basketball net indicated generally by reference 10. As shown in FIG. 3, the basketball net 10 comprises a basketball hoop or ring 20 and a backboard 30. The basketball hoop 20 is typically formed from a metal ring and mounted at ten feet above the basketball court or playing surface. The basketball hoop 20 is generally mounted in front of the backboard 30 which may be made of wood or plexi-glass. The basketball net 10 typically includes a support bracket 40, which connects the back-end of the hoop 20 to the backboard 30. Often there are respective brace members 42A and 42B that extend down from each side of the hoop 20 to either the bottom of the bracket 40 or to a suitable location on the backboard 30. The inside diameter of the basketball hoop 20 is normally eighteen inches, or about 45.7 cm.

Figure 1:
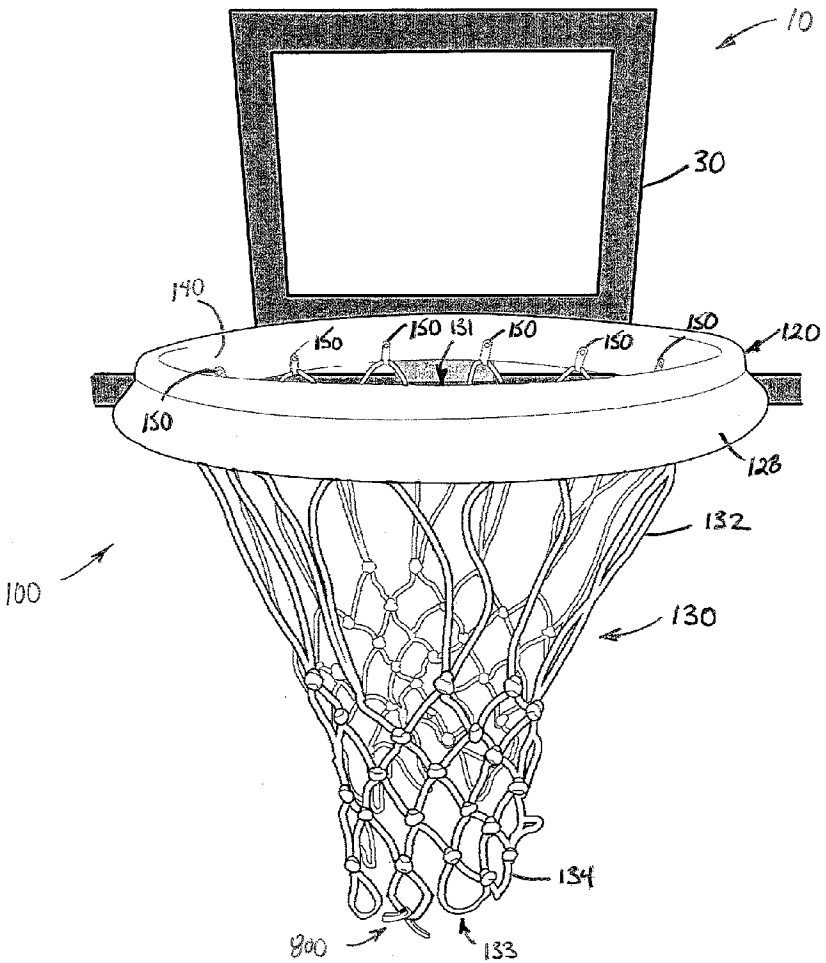
FIG. 1 is a perspective front view of a basketball net device according to an embodiment of the present invention.
Figure 4:
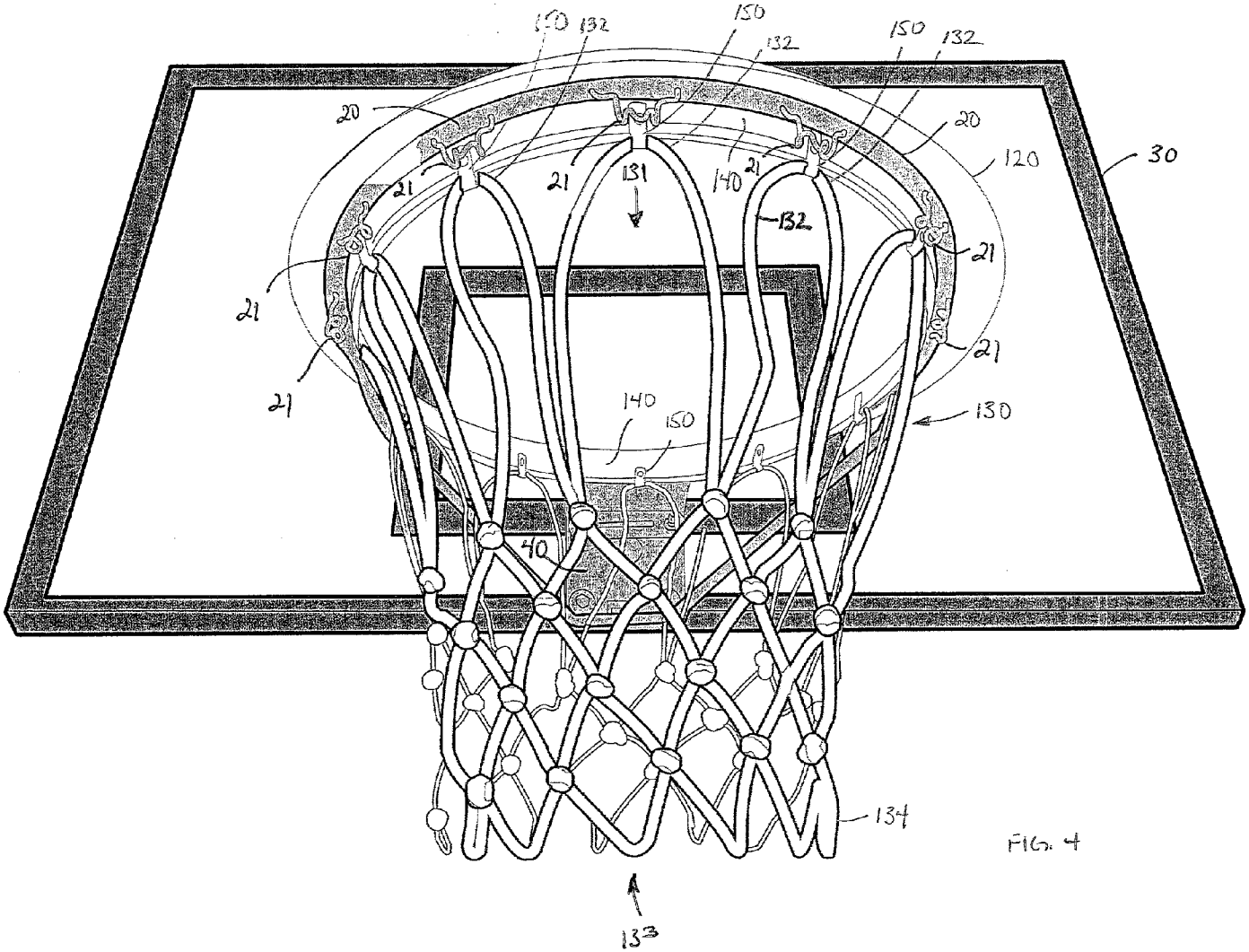
FIG. 4 is a perspective bottom view of the basketball net device of FIG. 1.

As shown in FIG. 1, the basketball net device 100 comprises a hoop ring or annular ring member 120 and a net indicated generally by reference 130. The net 130 comprises upper net cords 132 and lower net cords at 134 spaced from the upper net cords 132. The net 130 is constructed according to a specific embodiment as will be described in more detail below. The net 130 is sized to receive a standard basketball and to permit passage of the basketball therethrough. It is normally open at both a top end 131 and at a bottom end 133. It will be appreciated that in many basketball courts the netting is directly connected to the basketball hoop 20 by suitable means (for example, using net attachment coils 21 as shown in FIG. 4) but the netting can become damaged and torn away from the hoop so that the hoop is left with no net, a generally undesirable state of affairs for a proper game of basketball.

Figure 5A:
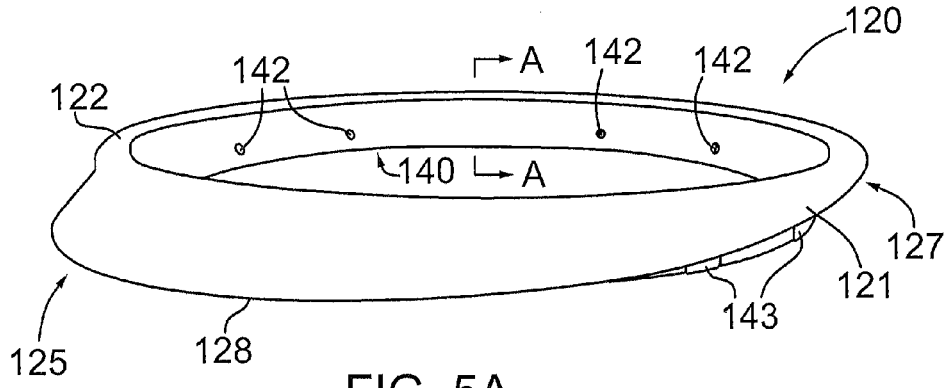
FIG. 5A is a front view of a hoop ring for the basketball net device of FIG. 1 according to an embodiment of the present invention.
Figure 5B:
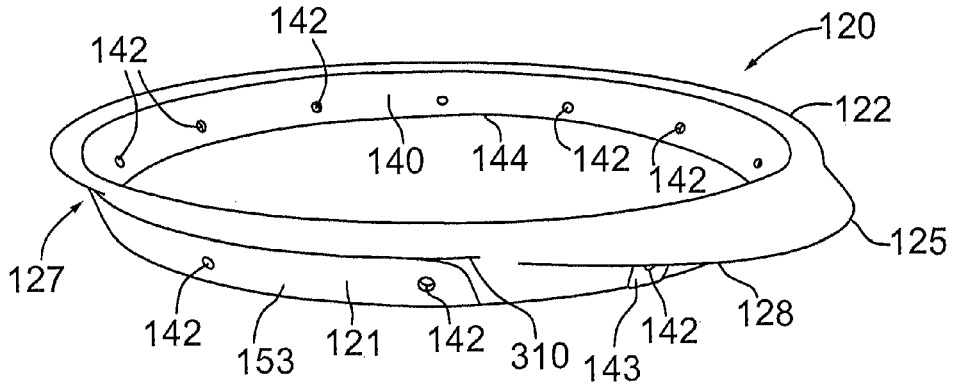
FIG. 5B is a rear perspective view of the hoop ring of FIG. 5A.

As shown in FIG. 3 and also in FIGS. 5A and 5B, the hoop ring or annular member 120 includes a hoop engaging section indicated generally by reference 122. According to an exemplary implementation, the annular member or hoop ring 120 is formed or made from a flexible and strong material, for example, ABS plastic, or other suitable material, as described in more detail below.

Figure 6:
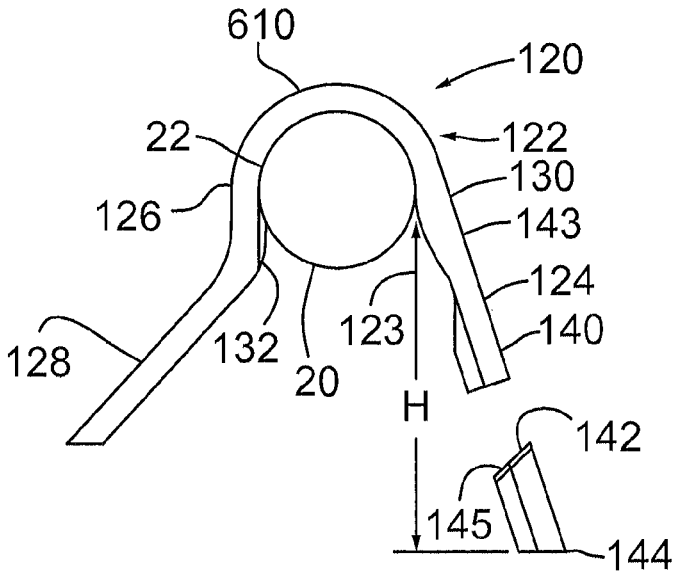
FIG. 6 is a cross-sectional view of the hoop ring of FIG. 5A taken along A-A.

For a substantial portion of the circumference of the annular member 120, the hoop engaging section 122 is generally channel-shaped in cross-section as shown in FIG. 6. The hoop engaging section 122 includes a radially inward section 124 that extends the entire circumference of the annular member and a radially outward section 126 that extends more than half way around, but not entirely around, the circumference of the annular member 120. In use of the basketball net device 100, the radially outward section 126 extends along a radially outer half 22 of the top half of the basketball hoop 20. The hoop engaging section 122 forms a channel 123 having a substantially open bottom and a semi-circular cross-section. As also shown in FIG. 6, the annular member 120 has an outwardly extending flange 128, which is connected to the outer edge of the hoop engaging section 122 and extends along more than one half the circumference of the annular member 120. The outwardly extending flange 128 is helpful in the installation of the net device 100 onto an elevated basketball hoop, for example, as described in more detail below. The outwardly extending flange 128 also helps to stiffen the annular member 120 and helps this member to retain a round shape. According to an exemplary implementation, the total width of the flange member 128 is approximately 2 cm.

Figure 5C:
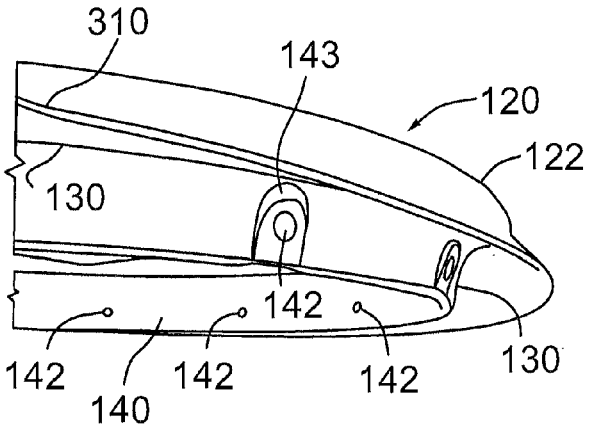
FIG. 5C is a partial bottom perspective view of the hoop ring of FIG. 5B.
Figure 5D:
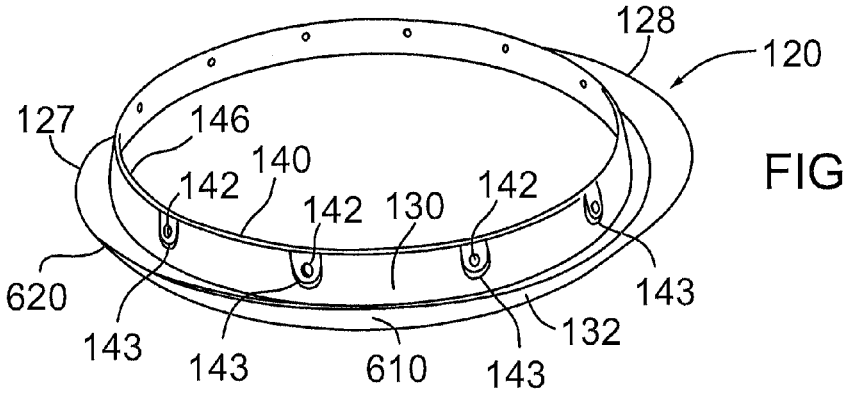
FIG. 5D is a top perspective view of the hoop ring of FIG. 5A with the hoop ring flipped over.
Figure 9A:
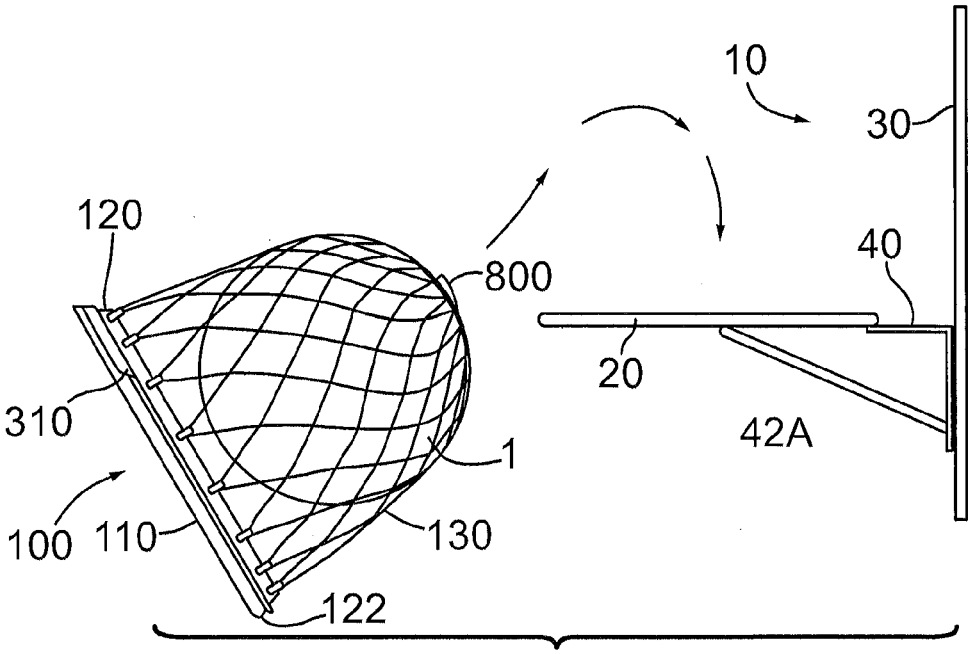
FIG. 9A shows in diagrammatic form a method for mounting the basketball net device of FIG. 1 on an elevated basketball hoop using a basketball.
Figure 9B:
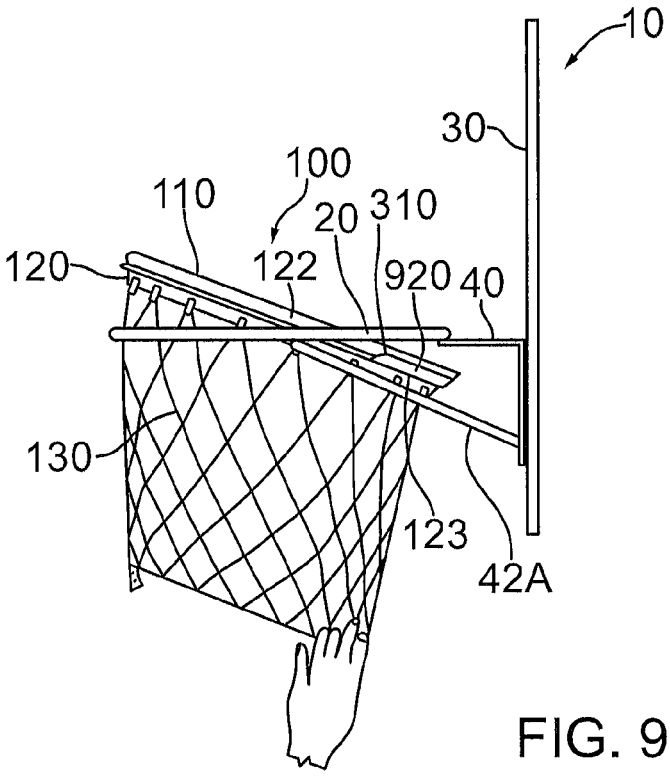
FIG. 9B shows in diagrammatic form a method for dismounting or removing the basketball net device of FIG. 1 from an elevated basketball hoop.

As shown in FIGS. 5C and 6, the hoop engaging section 122 includes a bulge or a positively displaced groove on the interior or net side indicated generally by reference 130. The bulge 130 extends substantially around the circumference of the hoop engaging section 122 that contacts the hoop ring 20 as shown in FIG. 5D. The annular member 120 also includes a corresponding bulge or positively displaced groove on the exterior side of the hoop engaging section 122 as shown in FIG. 6 and indicated generally by reference 132. The bulge 132 extends from the front section of the annular member 120 and tapers down to a minimal protrusion at approximately the center of the annular member 120, for example, as depicted in FIG. 5D. This configuration provides the annular member or hoop ring 120 with purchase to grip the metal basketball ring 20, and also allows the hoop ring 120 to rotate or pivot upwards at the front end and squeeze through the basketball ring 20 in a rotating downward motion, for example, as illustrated in FIG. 9B, as described in more detail below. According to another aspect, the bulge or positively displaced groove 130 can be formed as an integral element, e.g. molded into the wall of the hoop engaging section 122, and further function as a reinforcement rib.

Figure 2:
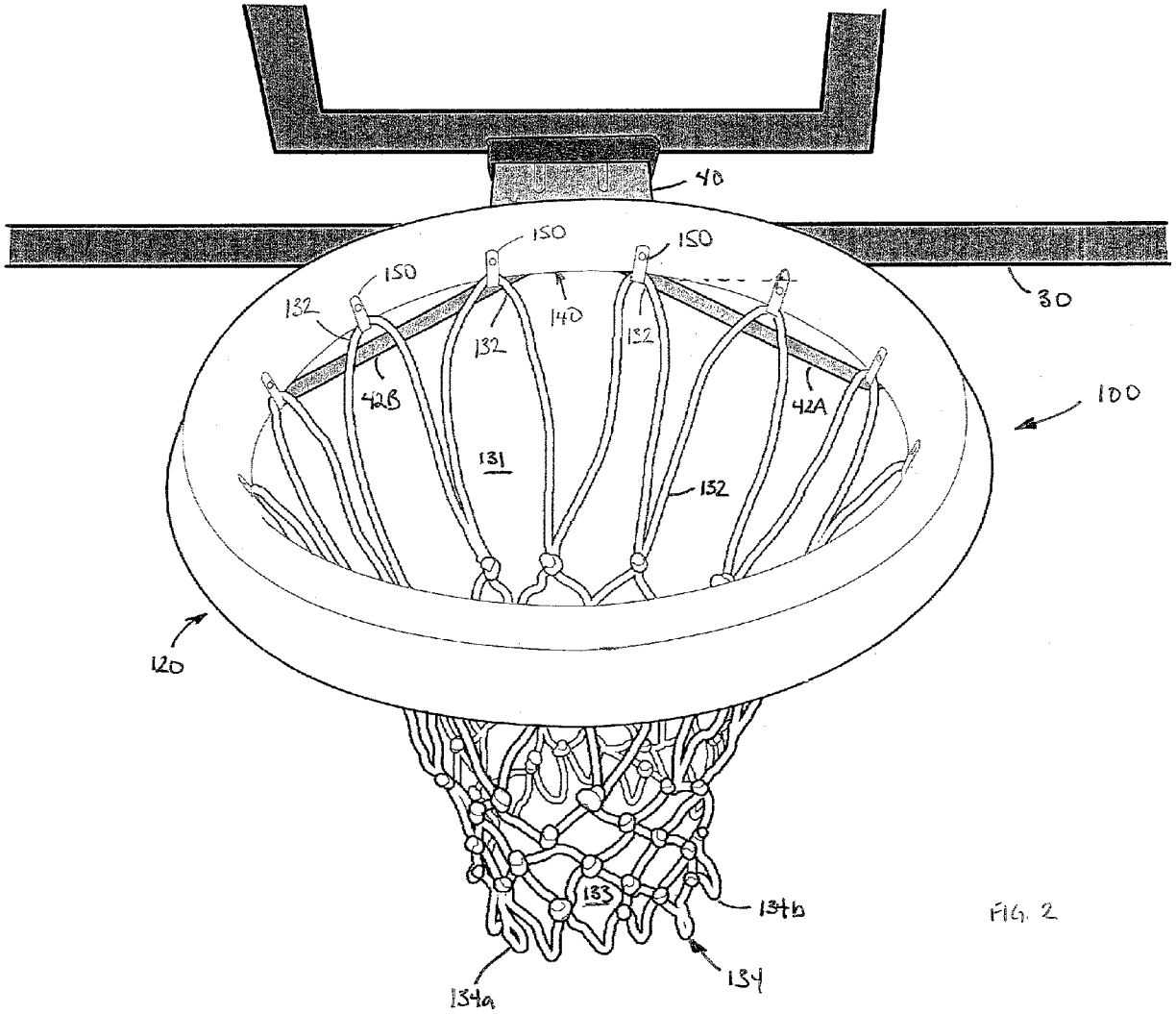
FIG. 2 is a perspective top view of the basketball net device of FIG. 1.

As shown in FIG. 2 and also in FIGS. 5A and 5B, the hoop ring or annular member 120 includes an annular skirt section indicated generally by reference 140. The annular skirt section 140 is configured to be positioned inside of the basketball hoop 20, when the basketball net device 100 is in the mounted position. As illustrated in FIG. 1, the upper net cords 132 are connected or affixed to the annular skirt section 140 utilizing a plurality of fasteners indicated generally by reference 150. The annular skirt section 140 also includes a number of spaced apart holes or apertures 142 distributed evenly around the circumference of the skirt section 140 and near the bottom portion of the skirt 140 configured for receiving or attaching the fasteners 150.

Figure 7A:
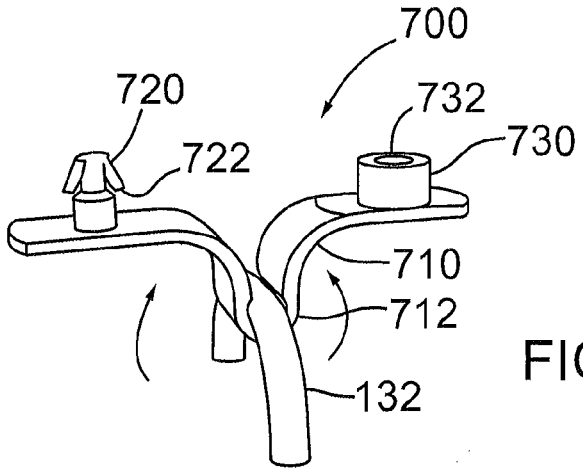
FIG. 7A is a perspective view of a hoop ring clasp according to an embodiment of the present invention.
Figure 7B:
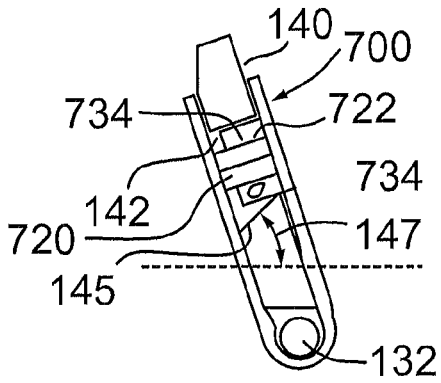
FIG. 7B is a side view of the hoop ring clasp of FIG. 7A in a closed or engaged position.

According to an embodiment, the fasteners 150 comprise a hoop ring clasp as shown in FIG. 7A and indicated generally by reference 700. The hoop ring clasp 700 comprises a body member 710, a clasp 720 and a locking barrel 730. The body member 710 comprises a groove or channel 712 configured to receive and support a section of one of the upper net cords 132 (FIG. 1), for example, as illustrated in FIG. 7A, and is configured to close or lock in the manner of a "butterfly" mechanism as described in more detail below. The groove or channel 712 is configured to hold the section of the upper cord net 132 so as to minimize movement relative to the hoop ring clasp 700. The locking barrel 730 is configured to be inserted through the hole or aperture 142 in the annular skirt section 140 from one side, and the clasp 720 is configured to be inserted through the same hole 142 but from the other side of the annular skirt section 140 and engages the locking barrel 730 in a locking or closed arrangement thereby securing the hoop ring clasp 700 and the section of the upper net cord 132 to the annular skirt section 140 (and the annular or hoop ring member 120), for example, as illustrated in FIGS. 2, 3 and 4. According to an embodiment, the clasp 720 comprises one or more deformable hooks or protrusions indicated generally by reference 722. The hooks 722 are inserted through a bore or opening 732 in the locking barrel 730 and engaged or held in place by shoulder 734 inside the bore 732 of the barrel 730, and the body member 710 closes around the upper net cord 132 (e.g. in a "butterfly" fashion) and the adjacent section of the annular skirt 140, as illustrated in FIG. 7B. It will be appreciated that the configuration of the hook ring clasp 700 comprises a mechanism for easily and securely connecting the basketball net 130 to the annular member 120 of the basketball net device 100, either during assembly at a manufacturer, or by a user replacing a net or assembling a device kit. According to another aspect, the hook ring clasp 700 is formed or fabricated from a material that is strong enough to withstand the usual wear and tear of aggressive basketball game play, but without adding undue weight. Suitable materials for the hook ring clasp 700 include Nylon, Nylon 6, Nylon 66 and polycarbonate. The particular manufacturing details for making the hook ring clasp 700 will be within the understanding of one skilled in the art.

According to another embodiment of the present invention, each of the hook ring clasps 700 are configured to rotate or pivot within the respective hole or aperture 142 in the annular skirt section 140 in order to emulate the game play characteristics as would be found in a conventional basketball metal ring/net setup. According to an exemplary implementation, the apertures or holes 142 have a diameter sufficient to receive the locking barrel 730 of the hoop ring clasp 700 and provide a secure connection, and also to provide enough clearance to allow the hoop ring clasp 700 to pivot or rotate together with the upper net cord 132 about the axis or center of the locking barrel 730. According to this embodiment, the hook ring clasp 700 is configured to hold the upper net cord 132 in the groove or channel 712 to minimize movement of the net cord 132 relative to the clasp 700 (as described above), while at the same time allowing for rotational movement at each individual attachment point of the hook ring clasp 700 and the net 130 relative to the annular skirt section 140 and therefore the metal hoop ring 20. It will be appreciated that this configuration will tend to minimize wear and tear on the net 130 itself.

According to another embodiment, the annular inner skirt 140 includes net attachment sections comprising reinforced or thicker sections adjacent each of the net mounting holes or apertures 142 as shown in FIGS. 5C and 5D, and indicated generally by reference 143. The thicker sections 143 are provided to strengthen and reinforce the annular skirt 140 around the attachment points associated with hook ring clasps 700 and the upper net cords 132, and may be formed as an integral component of the annular inner skirt 140 using fabrication techniques as will be understood by those skilled in the art. This configuration allows the wall thickness of the annular inner skirt 140 between the holes 142/section 143 to be reduced, thereby providing an opportunity to optimize weight and strength characteristics of the annular member 120 according to embodiment. In an exemplary implementation, the annular skirt 140 comprises 12 equally spaced net mounting holes 142 and associated strength-reinforced sections 143. As described above, each the 12 respective hook ring clasps 700 can rotate or pivot independently thereby allowing rotational movement of the net 130 relative to the annular member or hoop ring 120. According to another embodiment, two or more of the net sections 143 can be formed as contiguous or continuous section in the wall of the annular inner skirt 140, as shown in FIG. 5B and indicated by reference 153.

According to another embodiment, the annular inner skirt 140 comprises a rib 146 at or near the base or bottom edge of the annular skirt 140. The rib 146 extends around the circumference of the annular skirt 140, and is configured to strengthen increase the structural integrity of the skirt 140, and/or allow the wall thickness of the annular skirt 140 to be reduced based on the elastic strength and/or memory of the material or materials used in the fabrication of the annular member 120. According to an exemplary implementation, the annular member or hoop ring 120 is formed or fabricated as a unitary member using known molding techniques and the rib 146 is formed in the annular skirt 140 during the fabrication process. According to an exemplary implementation, the wall thickness of the annular inner skirt 140 can be approximately 2.0 mm, utilizing, for example, a polyurethane plastic material, as described in more detail below.

According to another aspect, the holes or apertures 142 in each of the sections 143 is configured at angle as illustrated in FIG. 7B. As shown, the hole 142 has a base section or lower edge 145 which is configured to be approximately at an angle of 44 degrees relative to the annular or hoop ring member 120 as indicated by reference 147. According to one aspect, this configuration eliminates undercuts in the tooling for making the holes 142. According to another aspect, this elliptical configuration of the holes 142 provides additional clearance or relief between the hoop ring clasp 700, e.g. the locking barrel 730, and the annular skirt section 140 allowing the hoop ring clasp 700 and attached net cord 132 to rotate or pivot without interference, for example, during game play.

As shown in FIG. 6, the annular skirt section 140 extends both downwardly and radially inwardly from its upper end located at about 143. At its upper end 143, the skirt section 140 is integrally connected to the inner perimeter of the hoop engaging section 122. According to an exemplary implementation, the annular skirt section 140 has height of approximately 4.5 cm as indicated by reference H in FIG. 6. According to another aspect, the annular skirt section 140 is generally steeply sloped at an angle to the horizontal plane of about 70 degrees or more and substantially less than 90 degrees. The provision of the skirt portion is desirable not only to increase the rigidity and strength of the annular member but also in assisting the device to locate itself properly on the basketball hoop when the device is being installed thereon. As clearly shown in FIG. 6, the annular skirt section 140 is configured to fit inside the metal basketball hoop 20 and its inner diameter defined by a bottom edge 144 is less than the inside diameter of the basketball hoop 20, which diameter is set at eighteen inches for a regulation basketball game.

Reference is next made to FIGS. 5A and 5B, which show that the hoop ring or annular member 120 having an outer portion of its hoop engaging section 122 that is cut away or removed, leaving only a narrow inner portion indicated by reference 121 that engages the inner half 22 of an upper surface of the metal basketball hoop 20, as illustrated in FIG. 6. The cut-out or cut-away section 121 extends around the circumference about half-way from the front 125 of the annular member 120 to the rear or back portion of the annular member 120, As described in more detail below, the narrow cut-away inner portion 121 in the hoop engaging section 122 permits the basketball net device 100 to be readily removed from the metal basketball hoop 20 by pulling down on the device 100 as illustrated in FIG. 9B. By grabbing on to the bottom of the net 130, as shown, one can pull the device 100, i.e. the annular ring 120 and net 130 through the circular opening formed by the metal hoop 20. This is due to the fact that the annular member or hoop ring 120 is sufficiently flexible, particularly in the region where hoop engaging section 122 has been reduced that it will bend and partially collapse to permit the reduced hoop engaging section 122 indicated at 920 in FIG. 9B to pass by the inside of the metal basketball hoop 20. At the same time, the basketball net device 100 commences a pivoting action so as to form an angle with the horizontal surface of the metal hoop 20 as shown in FIG. 9B. In order to assist in the removal of the device 100, the cut-away circumferential section 121 includes tapered end portions as indicated by reference 310 in FIG. 3 and also in FIGS. 5B and 9B. The tapered end portions 310 regions provide a transition from the reduced hoop engaging portion, the cross-section for which is shown in FIG. 6 to the remainder of the annular member 120 which has a full hoop engaging portion indicated by reference 610 (as also shown in FIG. 5D). The full hoop engaging portion 610 extends for a substantial portion of the circumference of the annular member 120, and, in an exemplary implementation, extends through an angle of about 270 degrees in the horizontal plane as shown in FIG. 5D. This leaves a circumferential section 620 as illustrated in FIG. 5D corresponding to the cut-away section 121 of the outer portion of the hoop engaging portion section 122 extending an angle of about 90 degrees around the circumference.

Figure 5E:
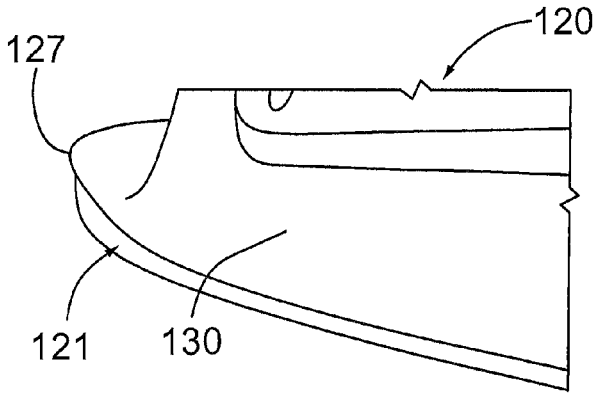
FIG. 5E is partial bottom perspective view of the hoop ring of FIG. 5D.

According to another aspect, the cut-away section 121 includes a radius indicated by reference 127 along the lower edge of the hoop engaging section 122 as shown in FIGS. 5D and 5E. The radius 127 reduces the otherwise sharp edge of the cut-away section 121 and lessens the possibility of injury.

Figure 8A:
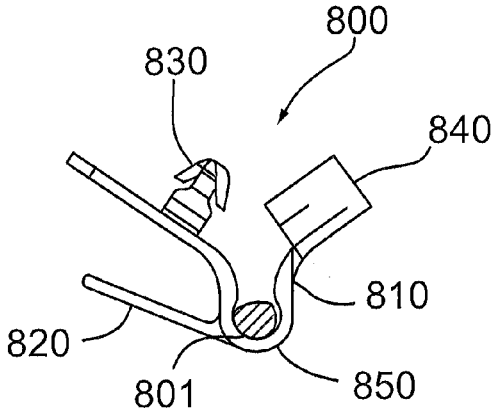
FIG. 8A is a side view of a net pin in an open position according to an embodiment of the present invention.

Reference is next made to FIG. 8A, which show a net pin clasp according to an embodiment of the invention and indicated generally by reference 800. According to an embodiment, the net pin clasp 800 is configured to temporarily close off the opening 133 (FIG. 2) at the bottom of the net 130 (FIG. 2) so as to prevent a basketball from passing completely through the net 130 for the purpose of mounting the basketball net device 100 in the elevated metal basketball ring 10, for example, as illustrated in FIG. 9A and described in more detail below. As shown in FIG. 8A, the net pin clasp 800 comprises a body member 810 and a hook section indicated generally by reference 820. The body member 810 includes a clasp 830, a locking barrel 840 and a channel or groove 850. The channel 850 is configured to receive or hold a portion of the netting 130, for example, a section 801 of the lower net 134. The clasp 830 is engaged with the locking barrel 840 to secure or lock the net pin clasp 800 onto a section 134*a* (as shown in FIG. 2) of the lower net 134. The hook section 820 of the net pin clasp 800 is configured to engage or hold another section 134*b* of the net 130 (as shown in FIG. 2) and temporarily close of the opening 133 of the net 130 as shown in FIG. 8B.

Figure 8B:
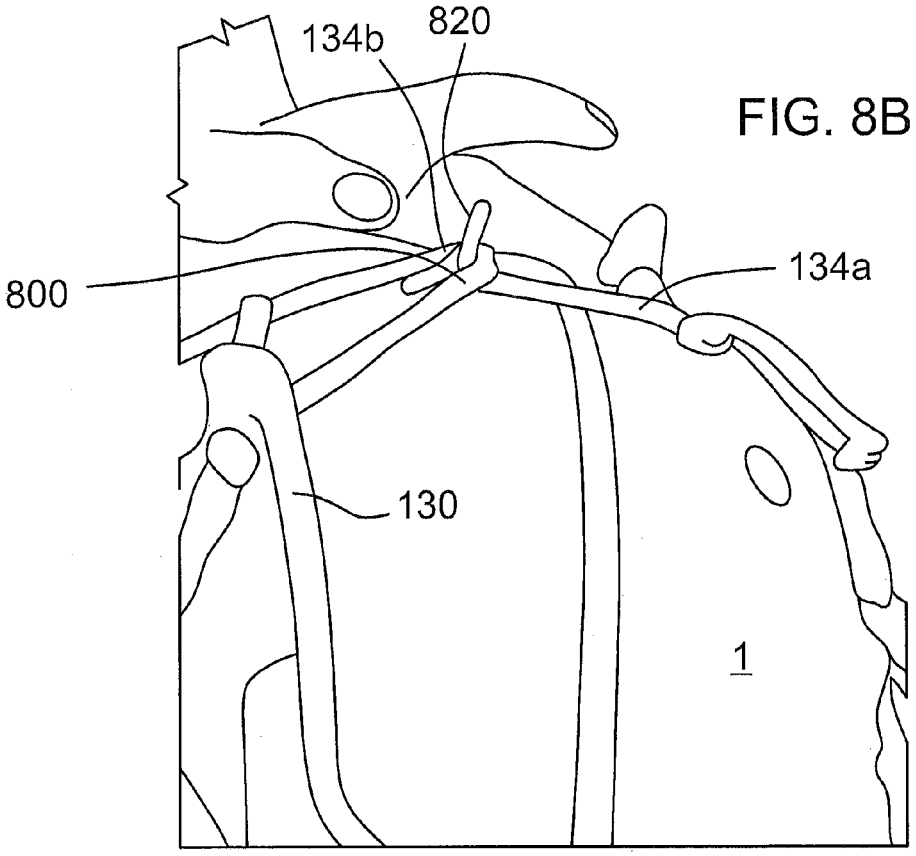
FIG. 8B shows a hoop ring configured with a pin clasp according to an embodiment of the present invention.

With the net opening 133 temporarily closed off using the net pin clasp 800, a standard basketball, indicated generally by reference 1, is inserted through the annular member 120 and placed fully into the closed-off net 130 as shown in FIG. 8B. It is then possible for a user of the basketball net device 100 to throw both the device 100 and the basketball 1 up and over the metal basketball hoop 20. Assuming that the user has thrown this combination with reasonable accuracy, the basketball 1 due to its weight will tend to pass first through the metal basketball hoop 20 and the annular member 120 will follow behind it. However, because the outer circumference of the annular member 120 is substantially greater than the interior diameter of the hoop 20, the annular member 120 will engage the top of the metal hoop 20. Then the weight and momentum of the basketball 1 and the fact that the basketball 1 will tend to center itself relative to the metal hoop 20 as it passes therethrough, will cause the hoop engaging section 122 (as shown in FIG. 6) to be pulled around and into full engagement with the hoop 20. The cut-away section 121 of the annular member 120 will tend to engage the adjacent section of the hoop in the manner shown in FIG. 3. Furthermore, the downward force and momentum of the basketball 1 once the annular member 120 has become engaged with the hoop 20, will generally force the net section 134*b* to disengage or separate from the hook section 820 of the net pin clasp 800 (FIGS. 8A and 8B), thereby opening the lower end of the net 130 and allowing the basketball 1 to fall through the net 130 so that it can be readily retrieved by the user.

It will be appreciated that the outwardly extending flange 128 (FIG. 6) that extends a substantial distance around the circumference of the annular member 120 (as shown in FIG. 5A) helps in the installation process in that the flange 128 will tend to slip over the rounded top of the metal basketball hoop 20 and down the outside of the hoop 20. Further, the engagement of the metal basketball hoop 20 with the bottom of the outwardly extending flange 128 will tend to pry open or open up the rounded channel (FIG. 6) formed by the hoop engaging portion 30. For this reason, the flange 128 extends both outwardly and downwardly from the outer edge of the hoop engaging section 122. According to an exemplary implementation, the flange 128 extends at an angle to the horizontal that is greater than 30 degrees, but which is less than 60 degrees, and is, for example, typically about 45 degrees to the horizontal.

Figures 10A, 10B, 10C, 10D:
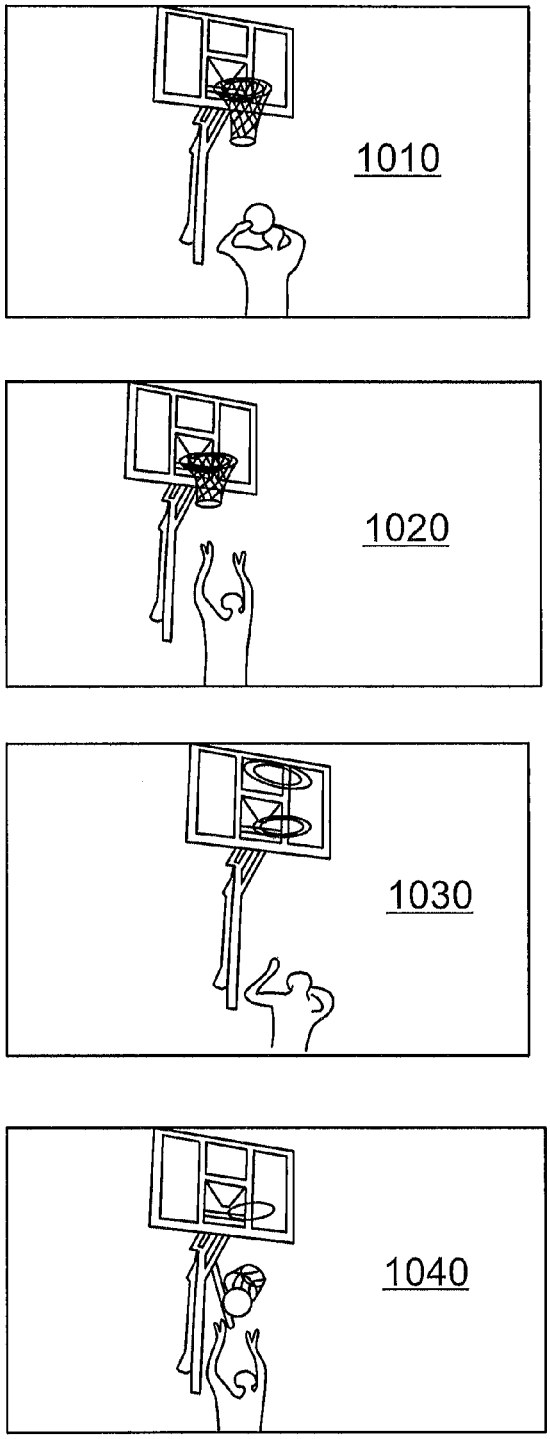
FIGS. 10A to 10D show a method comprising a sequence of steps for dismounting or removing the basketball net device of FIG. 1 from a basketball hoop according to an embodiment of the present invention.

Reference to next made to FIGS. 10A to 10D, which comprise a sequence of screen shots illustrating another method for removing the basketball net device 100 according to an embodiment of the present invention. According to this embodiment, the basketball net device 100 is pushed up and away from the metal hoop ring 20 to disengage the device 100. The first step as shown in FIG. 10A and indicated by reference 1010 comprises throwing or tossing a ball, e.g. a basketball, up through the base of the basketball net device 100. If the ball is thrown at a moderate velocity, for example, equivalent to the speed of a basketball shot, then the ball will catch the outside of the net 130 and continue to catch or engage the inside of the net 130 thereby applying a torque like force on the attached hoop ring 120 as indicated by reference 1020 in FIG. 10B, and detaching or disengaging the hoop ring 120 from the metal basketball ring 20 in the upward direction as indicated by reference 1030 in FIG. 10C. The disengaged basketball net device 100 and the basketball 1 can then be caught as indicated by reference 1040 in FIG. 10D. It will be appreciated that the method outlined above and illustrated in FIGS. 10A to 10D can be used to remove the basketball net device 100 without requiring the aid of a pole, ladder or the like.

In accordance with an embodiment of the present invention, the net 130 comprises net cords that are substantially stiffer than the net cords found in conventional basketball netting or nets. A stiffer net configuration can be achieved by utilizing net cords having a tight weave, or a stiffer, less flexible, material resulting in stiffer net cords and an overall stiffer net 130. By utilizing a stiffer net 130, the net cords 132, 134 remain rigid and are less likely to catch on the attachment coils 21 on the metal basketball ring 20, for example, as illustrated in FIGS. 3 and 4. According to another aspect, a stiffer cord configuration for the net 130 facilitates engagement of the moving basketball 1 (i.e. increased torque and/or friction with the ball contact and/or less deformation from contact with the ball) for removing the basketball net device 100 from the metal basketball ring 20, as described above with reference to FIG. 10.

The operational features of the hoop ring 120 as described herein require a material that exhibits durability and stiffness for game play, and particularly aggressive game play, while at the same time exhibits sufficient flexibility to allow removal according to one or both of the methods as also described herein. Suitable materials for fabricating (e.g. forming) the hoop ring 120 include the polyurethane family of plastic materials. Polyurethanes exhibit good durometer characteristics, a balance between stiffness and elasticity, which will benefit the long term performance of the hoop ring 120 which is subjected to repeated mounting and removal actions, and/or sustained aggressive game play. Other possible materials providing a general level of performance include polyethylene's, PVC, and the general family of synthetic elastomers, as will be readily understood by those skilled in the art.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A basketball net device for mounting on a basketball ring, said basketball net device comprising:

a tubular net having upper net cords and configured to receive a basketball and permit passage of said basketball through said tubular net;

a flexible annular member comprising a generally circular circumference and having a hoop engaging section comprising a channel extending around a substantial portion of said flexible annular member and configured for receiving the basketball ring, and said flexible annular member further comprising an annular skirt section configured to extend at an angle and be positioned inside of the basketball ring;

said annular skirt section including a plurality of net attachment sections, each of said net attachment sections including an aperture configured to receive a hook ring clasp for coupling a section of one of said upper net cords to said annular skirt section, and said aperture being further configured to allow said hook ring clasp to pivot together with said upper net cord;

wherein a circumferential section of said annular member has an outer portion of said hoop engaging section cut away forming a narrow inner portion configured to engage an inner half of an upper surface on the basketball ring; and wherein, outside of said circumferential section, said flexible annular member includes an outwardly extending flange connected to said hoop engaging section, and said outwardly extending flange extending along said annular member for more than one half of the circular circumference of said flexible annular member, said outwardly extending flange being configured to extend at an angle to said hoop engaging section; and wherein said hoop engaging section includes a positively displaced groove on a first surface of said hoop engaging section, said positively displaced groove extending into said channel to engage the basketball ring so as to secure said flexible annular member from being pushed up and disengaged from the basketball ring, wherein said hoop engaging section includes a second positively displaced groove on a second surface of said hoop engaging section, said second positively displaced groove extending into said channel to engage the basketball ring, and said second positively displaced groove extending from a front section of said annular member to said narrow inner portion and said second positively displaced groove being tapered to a minimal protrusion at said narrow inner portion.

2. The basketball net device as claimed in claim 1, wherein said annular skirt section comprises a uniform wall thickness, and each of said net attachment sections comprises a thickness greater than said uniform wall thickness so as to provide a reinforced section for supporting said hook ring clasp and said upper net cord.

3. The basketball net device as claimed in claim 2, wherein said hook ring clasp comprises a body member having a channel for coupling a section of said upper net cord, a cylindrical locking member and a hook member configured to engage said cylindrical locking member and secure said body member to said annular skirt section in a closed position.

4. The basketball net device as claimed in claim 3, wherein said tubular net comprises stiff net cords formed from a tightly weaved material.

5. The basketball net device as claimed in claim 3, wherein said aperture comprises a relief section configured to facilitate pivotal movement of the cylindrical locking member of said hook ring clasp.

6. The basketball net device as claimed in claim 2, wherein two or more of said net attachment sections are formed as a contiguous section in said annular skirt section.

7. The basketball net device as claimed in claim 2, wherein said annular skirt section includes a strengthening rib formed in a lower section in annular skirt section and extending substantially around the circumference of said flexible annular member.

8. The basketball net device as claimed in claim 1, further including a net clasp configured to temporarily close the lower section of said tubular net, said net clasp comprising a body member and a hook section, said body member being configured to attach to a lower net cord on said tubular net and said hook section being configured to releasably engage another lower net cord, so as to temporarily close the lower section of said tubular net.

9. A basketball net device for mounting on a hoop ring, said basketball net device comprising:

a tubular net configured to receive a ball and permit passage of said ball through said tubular net;

a flexible annular member comprising a generally circular circumference and having a hoop engaging section comprising a channel extending around a substantial portion of said flexible annular member and configured for receiving the hoop ring, and said flexible annular member further comprising an annular skirt section configured to extend at an angle and be positioned inside of the hoop ring;

said annular skirt section comprising a uniform wall thickness and a plurality of net attachment sections, each of said net attachment sections having a thickness greater than said uniform wall thickness so as to provide a reinforced section for supporting said tubular net, and each of said plurality of net attachment sections including an aperture for receiving a fastener for coupling a section said tubular net to said annular skirt section;

wherein a circumferential section of said annular member has an outer portion of said hoop engaging section cut away forming a narrow inner portion configured to engage an inner half of an upper surface on the hoop ring;

wherein, outside of said circumferential section, said flexible annular member includes an outwardly extending flange connected to said hoop engaging section, and said outwardly extending flange extending along said annular member for more than one half of the circular circumference of said flexible annular member said outwardly extending flange being configured to extend at an angle to said hoop engaging section; and wherein said hoop engaging section includes a positively displaced groove on a first surface of said hoop engaging section, said positively displaced groove extending into said channel to engage to the basketball ring so as to secure said flexible annular member from being pushed up and disengaged from the basketball ring, wherein said hoop engaging section includes a second positively displaced groove on a second surface of said hoop engaging section, said second positively displaced groove extending into said channel to engage the basketball ring, and said second positively displaced groove extending from a front section of said annular member to said narrow inner portion and said second positively displaced groove being tapered to a minimal protrusion at said narrow inner portion.

10. The basketball net device as claimed in the claim 9, wherein said fastener comprises a clasp fastener having a body member with a channel for receiving a section of said tubular, a cylindrical locking member and a hook member configured to engage said cylindrical locking member and secure said body member to said annular skirt section in a closed position.

11. The basketball net device as claimed in claim 10, wherein each of said apertures is configured to permit pivotal movement of the cylindrical locking member of said clasp fastener relative to said annular skirt section.

12. The basketball net device as claimed in claim 11, wherein said tubular net comprises stiff net cords formed from a tightly weaved material, so that said tubular net comprises a less flexible net structure than a conventional basketball net.

13. The basketball net device as claimed in claim 9, wherein said annular skirt section includes a strengthening rib formed in a lower section in annular skirt section and extending substantially around the circumference of said flexible annular member.

14. A basketball net device for mounting on a hoop ring, said basketball net device comprising:

a tubular net configured to receive a ball and permit passage of said ball through said tubular net;

a flexible annular member comprising a generally circular circumference and having a hoop engaging section comprising a channel extending around a substantial portion of said flexible annular member and configured for receiving the hoop ring, and said flexible annular member further comprising an annular skirt section configured to extend at an angle and be positioned inside of the hoop ring;

said annular skirt section comprising a uniform wall thickness and a plurality of net attachment sections, each of said net attachment sections having a thickness greater than said uniform wall thickness so as to provide a reinforced section for supporting said tubular net, and each of said plurality of net attachment sections including an aperture for receiving a fastener for coupling a section said tubular net to said annular skirt section;

wherein a circumferential section of said annular member has an outer portion of said hoop engaging section cut away forming a narrow inner portion configured to engage an inner half of an upper surface on the hoop ring;

wherein, outside of said circumferential section, said flexible annular member includes an outwardly extending flange connected to said hoop engaging section, and said outwardly extending flange extending along said annular member for more than one half of the circular circumference of said flexible annular member said outwardly extending flange being configured to extend at an angle to said hoop engaging section;

wherein said hoop engaging section includes a positively displaced groove on a first surface of said hoop engaging section, said positively displaced groove extending into said channel to engage to the basketball ring so as to secure said flexible annular member from being pushed up and disengaged from the basketball ring; and wherein said hoop engaging section includes a second positively displaced groove on a second surface of said hoop engaging section, said second positively displaced groove extending into said channel to engage the basketball ring, and said second positively displaced groove extending from a front section of said annular member to said narrow inner portion and said second positively displaced groove being tapered to a minimal protrusion at said narrow inner portion.

15. A method for disengaging a basketball net device as claimed in claim 1 from a basketball ring, the method comprising the steps of:

throwing a basketball in a generally vertical direction and at a moderate velocity into a lower section of the tubular net, so as to disengage said flexible annular member and said tubular net attached to said annular skirt section of said flexible annular member;

allowing said disengaged flexible annular member to fall under the force of gravity towards the ground; and catching said disengaged flexible annular member before hitting the ground.

16. The method as claimed in claim 15, wherein said tubular net comprises stiff net cords formed from a tightly weaved material.

17. A method for disengaging a basketball net device as claimed in claim 14 from a basketball ring, the method comprising the steps of:

throwing a basketball in a generally vertical direction and at a moderate velocity into a lower section of the tubular net, so as to disengage said flexible annular member and said tubular net attached to said annular skirt section of said flexible annular member;

allowing said disengaged flexible annular member to fall under the force of gravity towards the ground; and catching said disengaged flexible annular member before hitting the ground.

18. The basketball net device as claimed in claim 17, wherein said tubular net comprises stiff net cords formed from a tightly weaved material.

* * * * *